US006311858B1

(12) United States Patent
Csiszar

(10) Patent No.: US 6,311,858 B1
(45) Date of Patent: Nov. 6, 2001

(54) ADJUSTABLE LENGTH, MODULAR STORAGE DEVICE

(76) Inventor: Joe Csiszar, 124 N. Tuxedo, South Bend, IN (US) 46615

( * ) Notice: Subject to any disclaimer, the term of this patent is extended or adjusted under 35 U.S.C. 154(b) by 0 days.

(21) Appl. No.: 09/557,141

(22) Filed: Apr. 25, 2000

(51) Int. Cl.[7] ..... B65D 7/00

(52) U.S. Cl. ..... 220/4.03; 220/4.16; 220/4.26; 220/8

(58) Field of Search ..... 220/4.03, 4.16, 220/4.26, 3.7, 3.94, 8

(56) References Cited

U.S. PATENT DOCUMENTS

| | | | | |
|---|---|---|---|---|
| D. 258,268 | | 2/1981 | Axel . | |
| D. 332,746 | | 1/1993 | Garcia . | |
| 1,328,030 | | 1/1920 | Bard . | |
| 2,658,253 | * | 11/1953 | Richardson | 220/4.03 X |
| 3,061,134 | * | 10/1962 | Fesmire et al. | 220/4.26 X |
| 3,134,499 | * | 5/1964 | Johnson | 220/8 |
| 3,196,229 | | 7/1965 | Glass . | |
| 3,337,086 | * | 8/1967 | Jenks | 220/4.16 |
| 3,429,473 | * | 2/1969 | Vroman et al. | 220/4.16 X |
| 4,050,605 | * | 9/1977 | Wakana et al. | 220/8 X |
| 4,079,835 | | 3/1978 | Kendig . | |
| 4,082,187 | | 4/1978 | Carlson . | |
| 4,235,338 | | 11/1980 | Dugan et al. . | |
| 4,523,692 | | 6/1985 | Lemkin . | |
| 4,555,023 | | 11/1985 | Sykes et al. . | |
| 4,593,816 | | 6/1986 | Langenbeck . | |
| 4,733,773 | | 3/1988 | LaBianca et al. . | |
| 4,995,513 | | 2/1991 | Rosler . | |
| 5,042,674 | | 8/1991 | Ramsay et al. . | |
| 5,346,371 | | 9/1994 | Bialy et al. . | |

* cited by examiner

*Primary Examiner*—Steven Pollard
(74) *Attorney, Agent, or Firm*—Welsh & Katz, Ltd.

(57) ABSTRACT

An adjustable length containing device comprises modular, molded polymer members. The containing device members are ribbed and attached to each other by connection flanges and bottom panels. The containing device is used to store and ship heavy, large objects and is used as an underground storage tank.

19 Claims, 10 Drawing Sheets

ADJUSTABLE LENGTH, MODULAR STORAGE DEVICE

FIELD OF THE INVENTION

This invention relates to an adjustable length, modular storage device. More particularly the invention relates to a storage device formed as a modular assembly that includes molded end and center members.

BACKGROUND OF THE INVENTION

Storage devices are well known in the art. Most if not all are designed to meet unique requirements. For example, storage or containing devices have been configured to hold ammunition (U.S. Pat. No. 4,733,773—LaBianca et al.), mail (U.S. Pat. No. 4,593,816—Langenbeck) and other random articles. The known containing devices, however, do not teach, for example, an effective modular structure to transport heavy tubing or an efficient modular structure for use as a septic tank but, instead, teach of containing devices that allow objects to be transported in a secure manner, or objects to be transported in an organized manner. As a result, the known devices do not teach of a storage or containing device that is modular and includes a rib assembly, which device is adjustable in length and incorporates sections or portions formed from a molded polymer.

Accordingly, there exists a need for an adjustable length, modular containing device. Desirably, such a configuration is configured for use as a reusable shipping container and alternatively as an underground storage device or tank. Most desirably, such a device includes a rib assembly to support extreme loads from, for example, heavy objects such as tubing. In addition, a most desirable device has an adjustable length to allow storage of discrete, precisely sized objects such as tubing of varying lengths for transport. Again, most desirably, such a device is modular and is formed for durability, light weight and structural strength.

SUMMARY OF THE INVENTION

When used as a reusable shipping container, the adjustable length containing device comprises end and center members that are modular and formed from a molded polymer such as Telene. The end and center members further include a rib assembly formed thereon. The rib assembly comprises a lateral and a supporting rib pattern. The lateral rib pattern has externally and internally protruding ribs formed on the lateral surfaces of the end and center members. The supporting rib pattern, on the other hand, is formed on a base of the end and center members and further includes enclosed and open portions; the open portions have three sections formed by two dividers. In addition, the end and center members have strategically placed elevated stabilizers located on their respective substructures to add additional support to the shipping container.

The end and center members may also be attached to each other by connection means. The connection means may include protruding flanges and a bottom panel. Both the protruding flanges and bottom panels may also have a plurality of threaded bolt receiving elements formed therein. Bolts and nuts can be used to attach and secure the end and center members to each other.

In an alternate embodiment, the adjustable length containing device may be used as a septic tank. The septic tank comprises molded bottom and top end members and further includes bottom and top center members. The top end and center members incorporate predetermined located openings for inlet, egress, and cleaning purposes. In addition, the septic tank incorporates connection flanges to connect adjacent members to one another. Threaded openings are formed within the connection flanges to allow bolts to be threaded within the members to attach the adjacent members to one another.

BRIEF DESCRIPTION OF THE FIGURES

Further objects of the invention, taken together with additional features contributing thereto and advantages occurring therefrom, will be apparent from the following description of the invention when read in conjunction with the accompanying drawings, wherein.

DETAILED DESCRIPTION OF THE PREFERRED EMBODIMENTS

Figure 1:
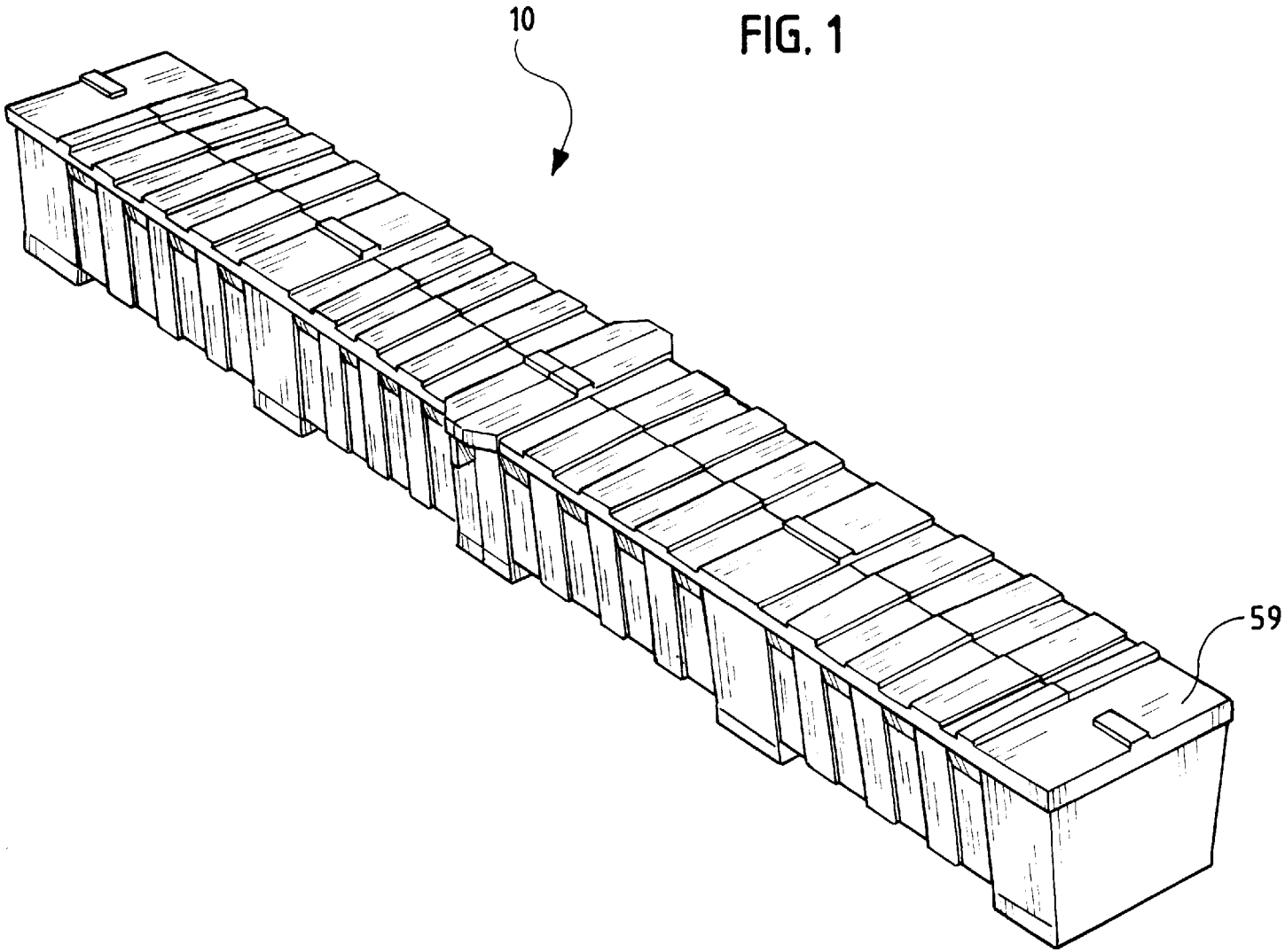
FIG. 1 is a perspective view of an adjustable length modular storage device embodying the principles of the present invention, the device is illustrated with a pair of end members attached to one another and a cover attached thereto.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiment illustrated.

Referring now to FIGS. 1–4, there is shown a first embodiment of the adjustable length modular storage device configured as a reusable shipping container 10 used to transport heavy tubing. In this embodiment, the adjustable length containing device 10 contains two end members 12 secured to one another. Each end member 12 has two upstanding elongated side walls 16 that are formed integral with a base 18, and two ends walls 20, 22. One of the end walls is an external end wall 20, while the other end wall is an internal attachment wall 22. The internal attachment wall 22 is configured to be joined or connected to a like internal attachment wall 22 of an adjacent end member 12. The external end wall 20 is, of course, the outer portion of the storage device constituting the end of the device.

The storage device can also include one or more center or intermediate sections 14 between and adjoining one another. As will be explained in more detail below, when used as a "standard" tube transport container, these sections permit secure transport of "standard" tubing lengths.

In a most preferred embodiment, the side 16 and external end walls 20 are formed at an outturned angle α relative to the base 18. The angle α should be greater than 90 degrees and is preferably about 95 degrees. The angled configuration provides a number of advantages. First, it permits nested stacking of the containers 10 in that the containers will "fit" into a next below container. In addition, this angled configuration facilitates easy placement of tubes into and removal from the containers 10. That is, because the tubes will naturally pack down due to gravity, the angled, outwardly sloping surface will provide more lateral space when placing and removing the tubing.

As will also be recognized by those skilled in the art, the internal attachment walls 22 are formed perpendicular to the base 18 so that an internal attachment wall of another end or intermediate section can be joined thereto with the internal walls 22 being flush with one another.

Both the end 12 and center members 14 are modular and can be formed from an injection molded polymer. In a most preferred embodiment, the members are formed from a reaction molded polymer where the polymer is Telene®, which is commercially available from The Telene Products Division of B.F. Goodrich, 9911 Brecksville Road, Cleveland, Ohio 44141.

Figure 2:
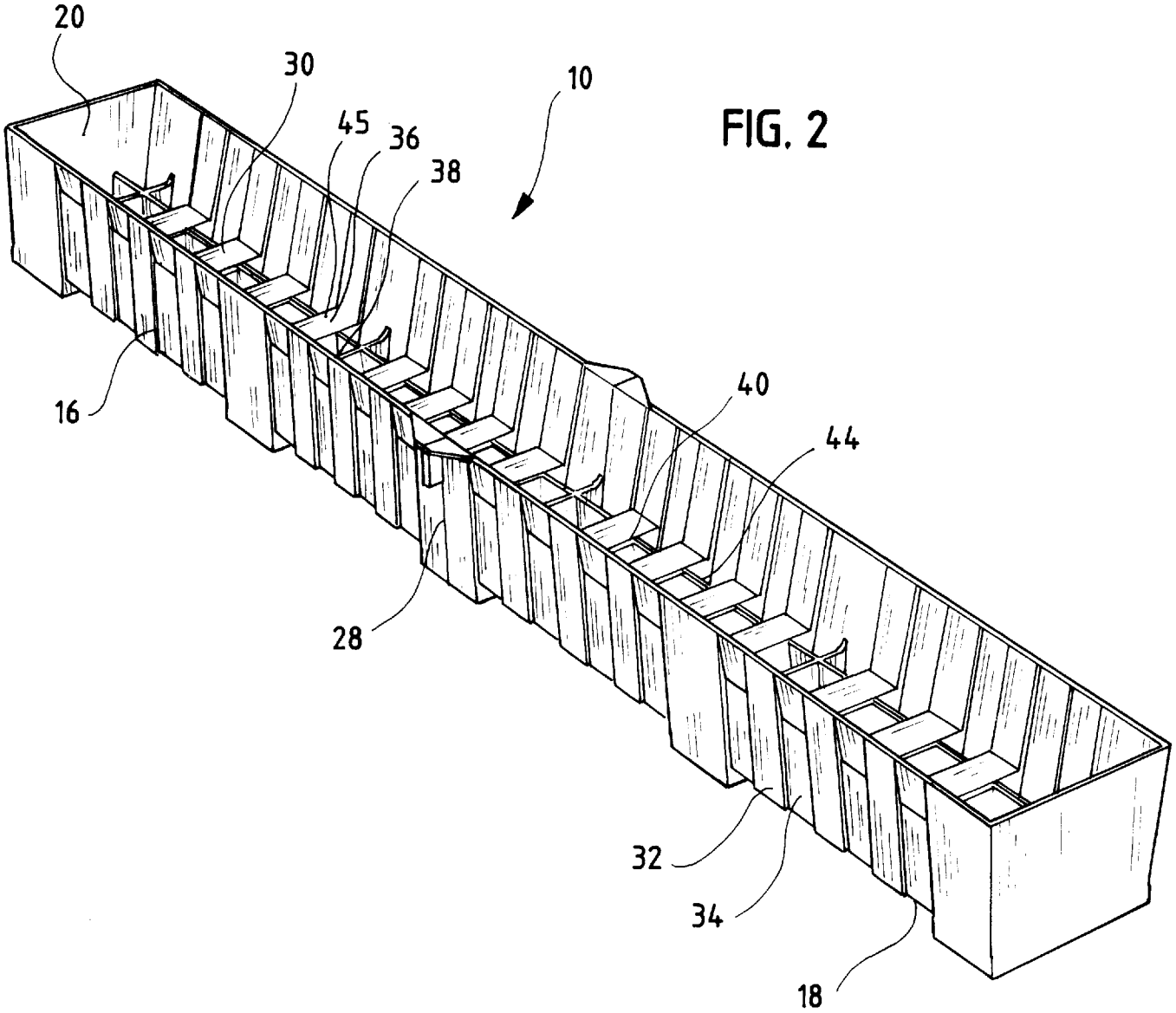
FIG. 2 is a perspective view of the device of FIG. 1 with the cover removed.
Figure 3:
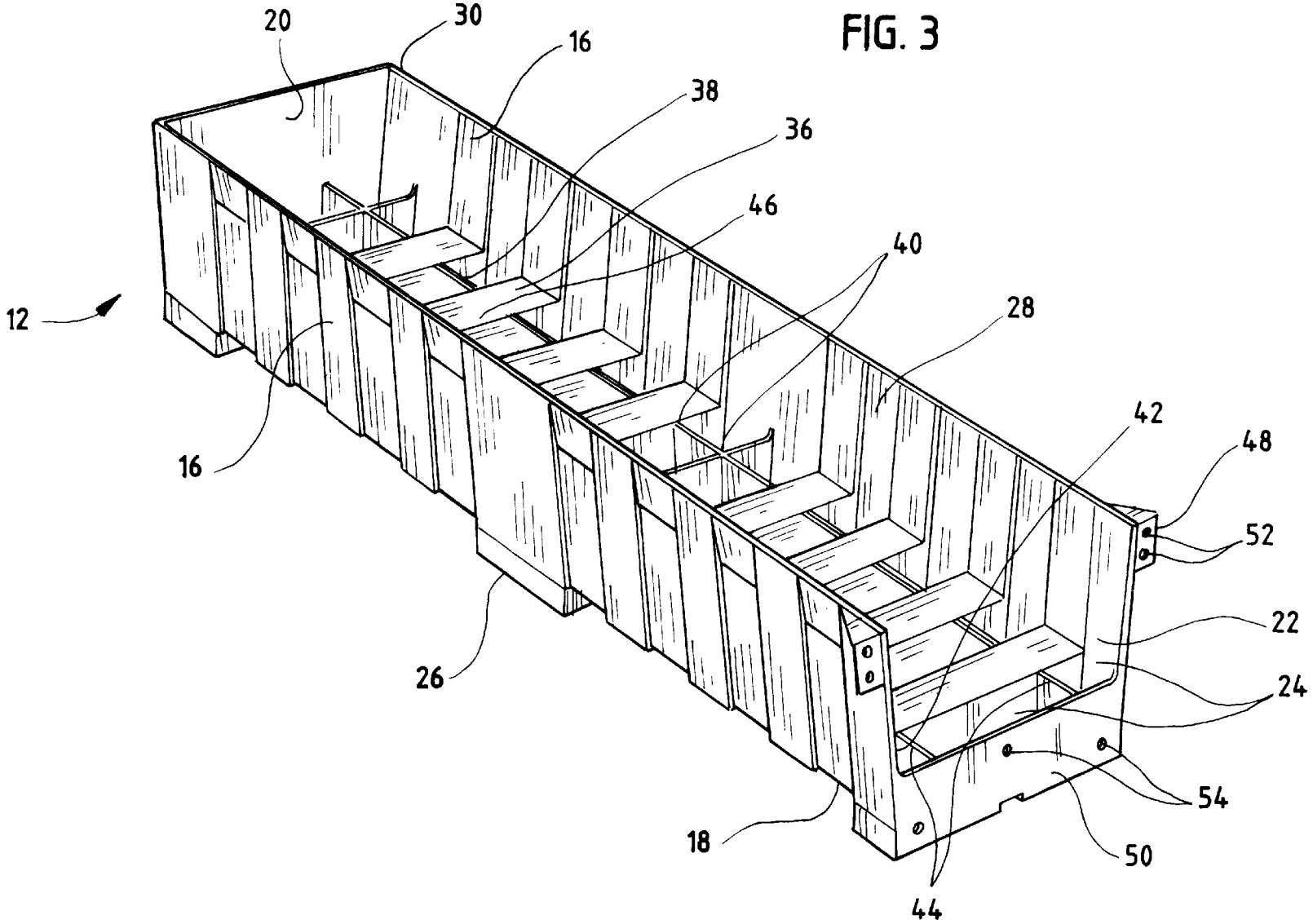
FIG. 3 is a perspective view of an end member of the storage device.
Figure 4:
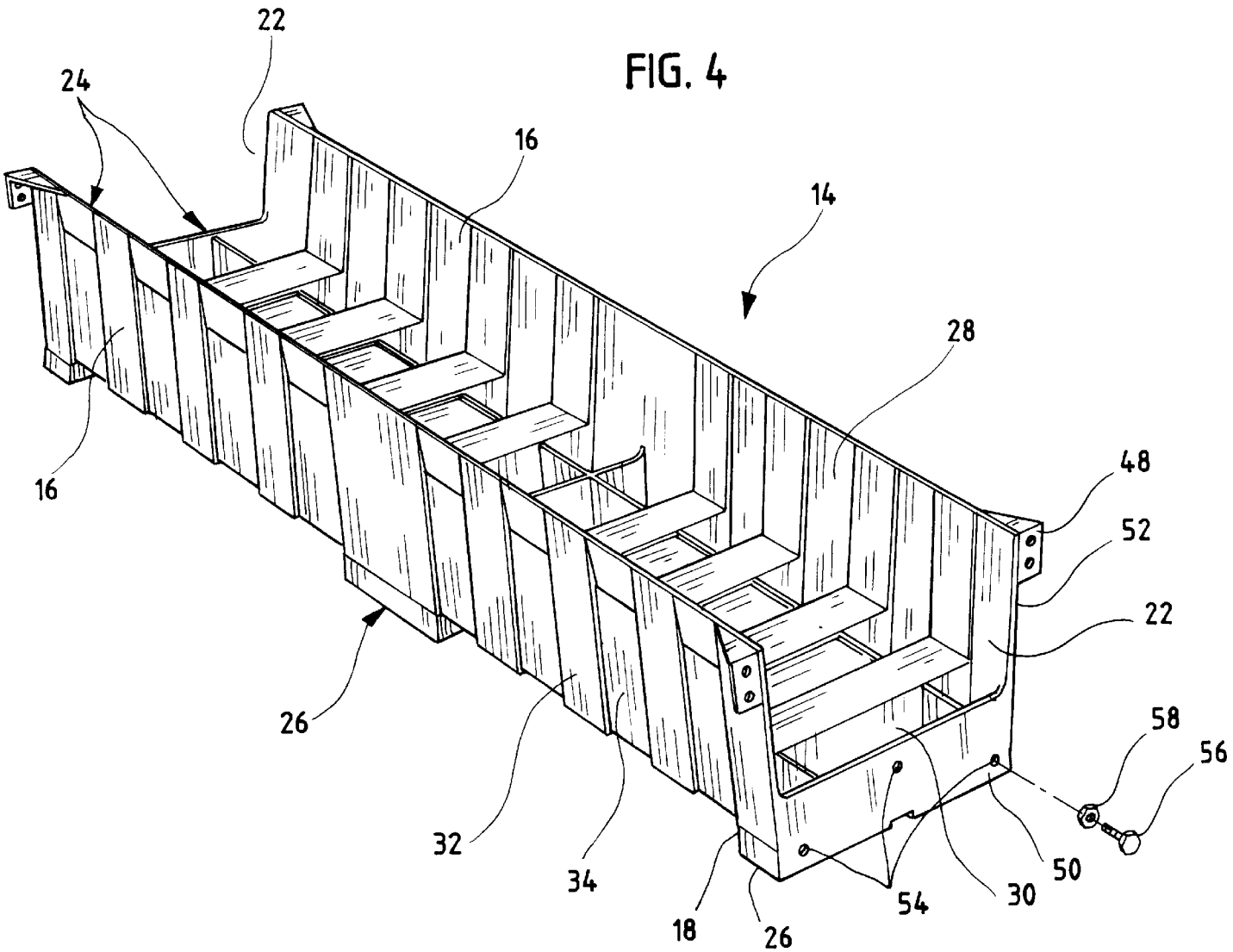
FIG. 4 is a perspective view of a center or intermediate member of the storage device.

In a preferred embodiment, as show in FIGS. 2–4, the end members 12 and center member 14 have an rib assembly 24 formed therein that incorporates elevated stabilizers 26. The rib assembly 24 and elevated stabilizers 26 can help the reusable shipping container 10 bear extreme loads that may be exerted on the container 10 by the heavy tubing. The rib assembly 24 includes a lateral rib pattern 28 and a supporting rib pattern 30. In a preferred embodiment, the lateral rib pattern 28 is formed on the lateral surfaces 16 of the end 12 and center members 14 and includes both externally 32 and internally protruding ribs 34. The supporting rib pattern 30 can be formed on the base 18 of the end 12 and center members 14 and can include alternating enclosed 36 and open portions 38 that are separated by horizontal dividers 40. Desirably, the open portions 38 define three separate sections 42 formed by two vertical dividers 44 placed within each open portion 38. The enclosed portions 36 include upper walls 46 that extend between the horizontal dividers 40.

As illustrated in FIGS. 1–2, in a preferred embodiment, the end 12 and center members 14 also include elevated stabilizer elements 26 located below the base 18 of the members 12, 14. The stabilizer elements 26 provide additional stability to the reusable shipping container 10 and are located to ensure that the shipping container 10 can withstand the extreme loads that the heavy tubing may exert upon it.

As depicted in FIGS. 3–4, connection members are used to connect the end members 12 to each other or alternatively, to attach the end members 12 to at least one center member 14. The connection members are located on the internal attachment walls 22 of the end 12 and center members 14. In a preferred embodiment, the connection members include at least two laterally protruding connection flanges 48 and a bottom connecting panel 50. Preferably, for increasing rigidity and strength, the connection flanges 48 are formed at upper sections 52 of the internal walls 22 and the bottom panels 50 are formed at the base 18 of the internal walls 22. In a preferred embodiment, a plurality of bolt receiving elements or openings 54 are formed within the flanges 48 and panels 50 so that the bolt receiving elements 54 align with one another when adjacent container members are connected. Fasteners, such as bolts 56 can then be inserted through the bolt receiving elements 54 and, for example, nuts 58 can be used to secure the bolts 56 and container members 12, 14 in place.

Figure 5:
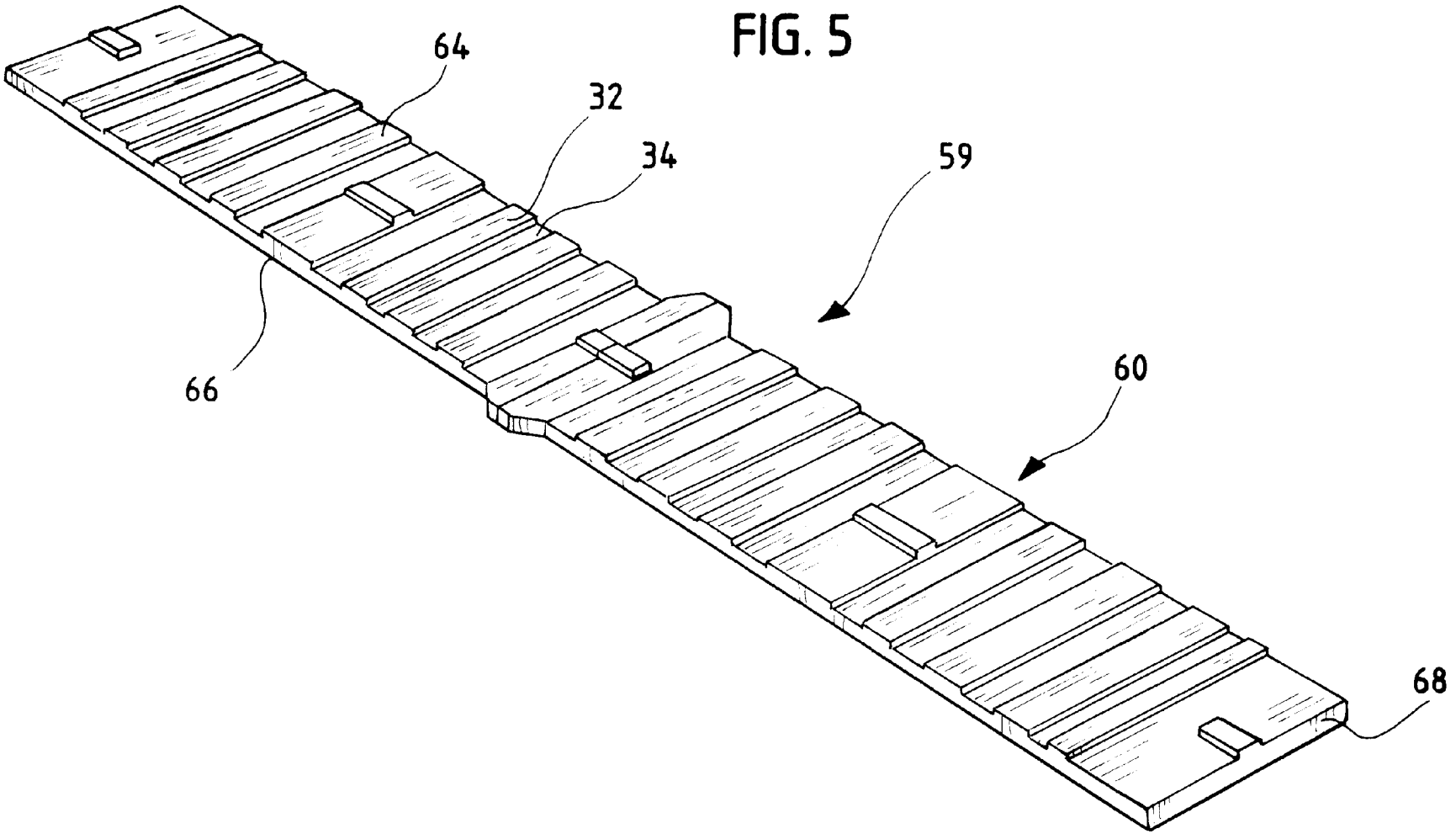
FIG. 5 is a perspective view of the cover of FIG. 1.
Figures 6, 6A:
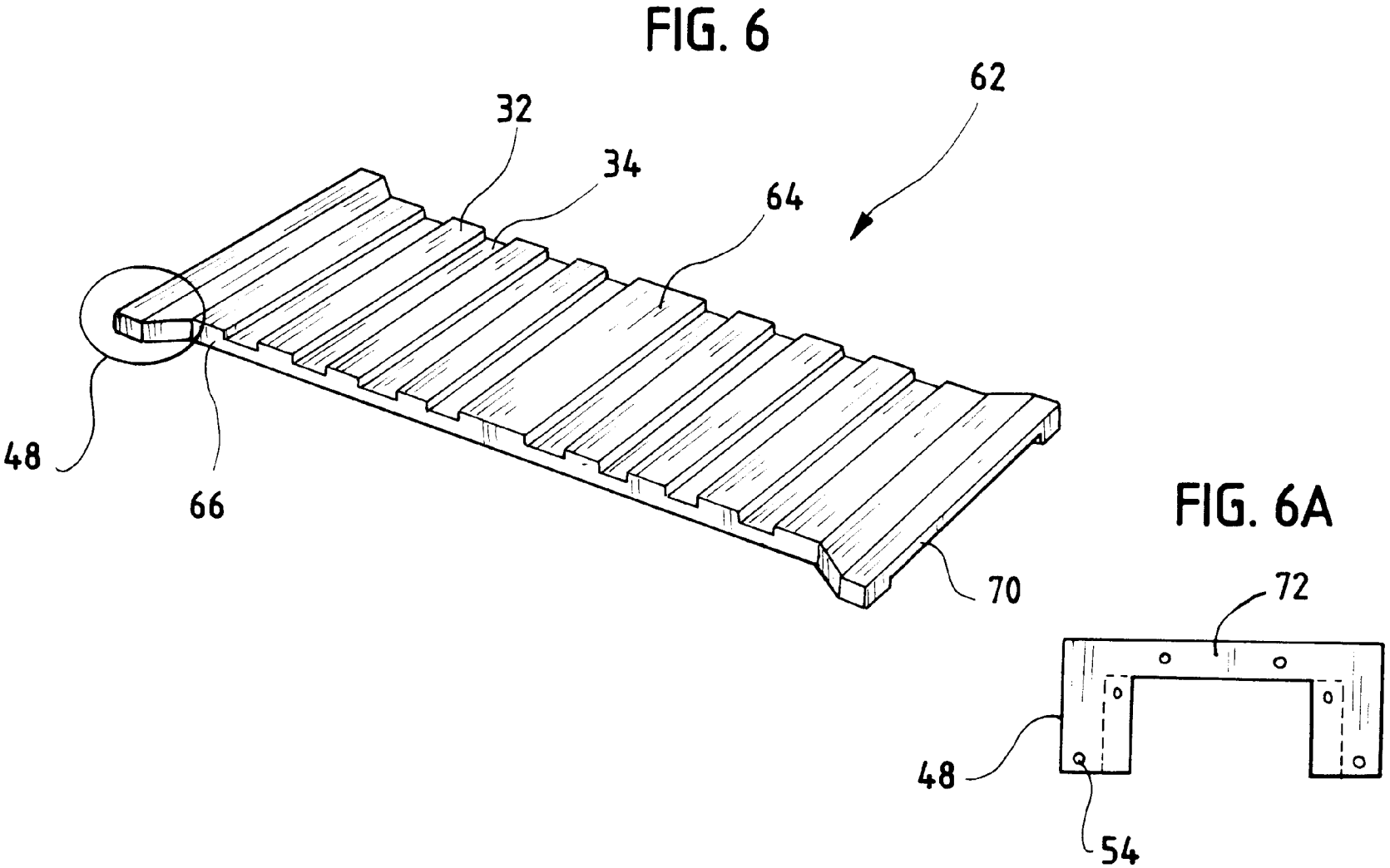
FIG. 6 is a perspective view of a center cover member.
FIG. 6A is an front view of an internal attachment panel of a cover member.

As depicted in FIG. 5, the adjustable length modular storage container includes a cover 59 formed from a plurality of modular, injection molded polymer cover members 60, 62. In a preferred embodiment, the cover 59 includes a plurality of modular, reaction molded polymer cover members 60, 62, has two cover end members 60 and can have a number of cover center members 62. The cover end members 60 are formed from a top 64 integral with two depending side flaps 66. The cover end members 60 also have an integrally formed exterior end slip 68 at a first end and an integrally formed attachment panel 70 at a second end. A cover center member 62 is shown in FIG. 6. The cover center members 62 have a top 64 integral with two depending side flaps 66 and also have two integrally formed attachment panels 70 at first and second ends. In a preferred embodiment, the tops 64 of the cover center and end members 60, 62 respectively, are ribbed with externally 32 and internally 34 protruding ribs.

As depicted in FIG. 6A, for the purpose of connecting the cover members 60, 62 to one another, the cover members 60, 62 have connection members at the attachment panels. In a preferred embodiment, the connection members include at least two laterally protruding connection flanges 48 and an upper attachment segment 72. Desirably, for increasing rigidity and strength, the connection flanges are formed at lower portions of the attachment panels 70 and the upper attachment segments 72 are formed at the top 64 of the attachment panels 70. In a preferred embodiment, a plurality of bolt receiving elements or openings 54 are formed within the flanges 48 and upper attachment segments 72 so that the bolt receiving elements 54 align with one another when adjacent cover members 60, 62 are connected. Fasteners, such as bolts 56 can then be inserted through the bolt receiving elements 54 and, for example, nuts 58 can be used to secure the bolts 56 and cover members 60, 62 in place. In the preferred embodiment, a steel or plastic strapping mechanism can be used to secure the cover 59 to the adjustable length container 10.

Figure 7:
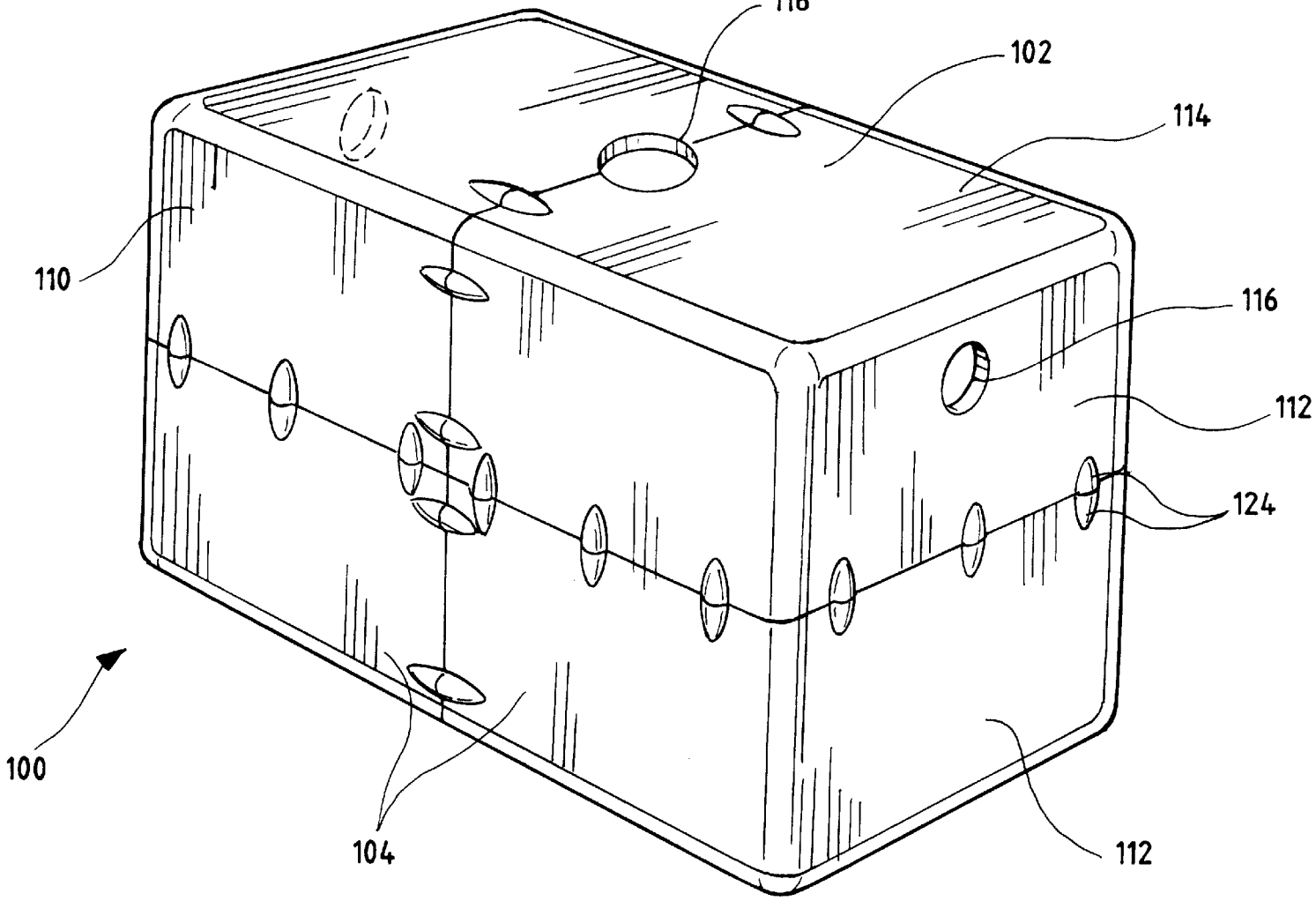
FIG. 7 is an alternate embodiment of the adjustable container device illustrating use as a septic tank.
Figure 8:
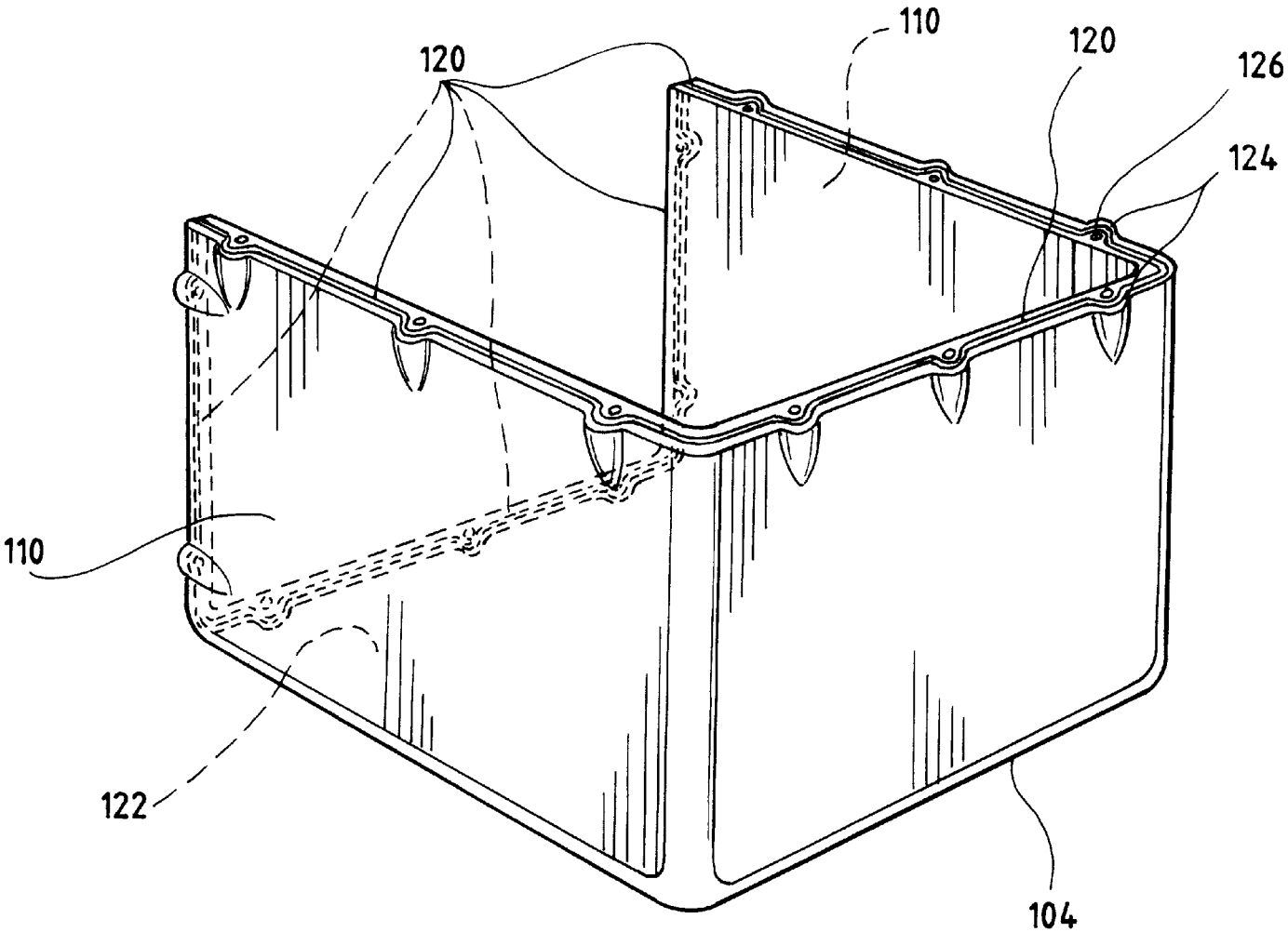
FIG. 8 is a perspective view of a bottom end member of the septic tank.

As shown in FIGS. 7–8, the modular adjustable length containing device can also be used as a septic tank 100. The septic tank 100 includes top and bottom end members 102, 104, respectively and can also include top and bottom center members 106, 108, respectively. The members 102, 104, 106,108 are modular and are formed from an injection molded polymer. In a preferred embodiment, the members are formed from a reaction molded polymer where the polymer is the aforementioned Telene®. Because of the members 102, 104, 106, 108 unique modular and injection molded construction (or reaction molded construction in the case of the preferred embodiment), the members have light weight but high-strength walls which facilitate easy installation of the septic tank. In addition, the unique construction of the septic tank provides excellent corrosion resistance to water and acids and advantageously prevents seepage.

As will be recognized by those skilled in the art, known below ground septic systems include tanks that are formed from massive, single piece concrete "bunkers" or shells. Typically, these one piece tanks require a considerable amount of labor and machinery (e.g., crews) to put in place. Moreover, because of the inflexible nature of concrete, these tanks can be easily cracked or damaged if mishandled. As such, the tanks require a relatively high standard of care in handling and installing.

The present invention, on the other hand, provides untold advantages over the known concrete bunker tanks. The light weight, modular construction permits perhaps as few as two installers to, for example, move and install the tank without concerns of breakage or damage. In addition, as will be readily recognized, the modular tank can be configured in a variety of sizes (e.g., volumes) with any number of arrangements of inlet and outlet connections and types (e.g. flanged, flare-fitted and the like).

As shown in FIGS. 7–8, the top end members 102, 104 each have two parallel lateral surfaces 110 perpendicular and integral with an end surface 112 and a top surface 114. The end surfaces 112 of the top end members 102 have openings 116 formed therein to allow for ingress and egress of various liquids and solid refuse. In addition, a semi-circular opening 118 is formed on the top surface 114 of the top end members 102. The semi-circular openings 118 are centrally located on an open side 120 of the top surfaces 114 of the top end members 102 so that the semi-circular openings 118 form complete circular openings when adjacent top members 102, 106 are connected to one another. The circular opening can also be used as an inspection/clean out opening on the top side of the septic tank. Bottom end members 104, on the other hand, include two parallel lateral surfaces 110 perpendicular and integral with an end surface 112 and a bottom surface 122. Each top and bottom end member in the illustrated embodiment has six open sides 120.

Figure 9:
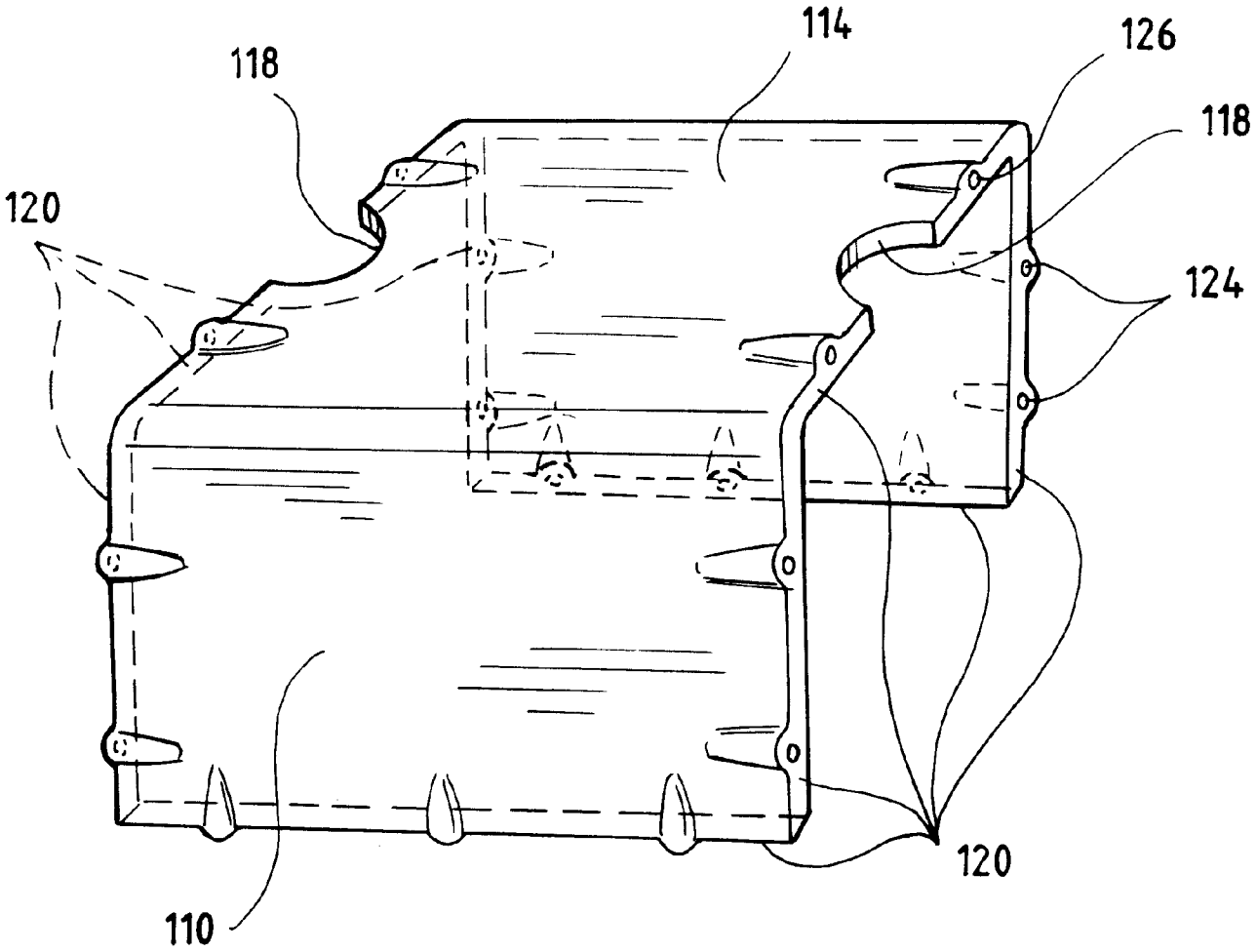
FIG. 9 is a perspective view of a top center member of the septic tank.
Figure 10:
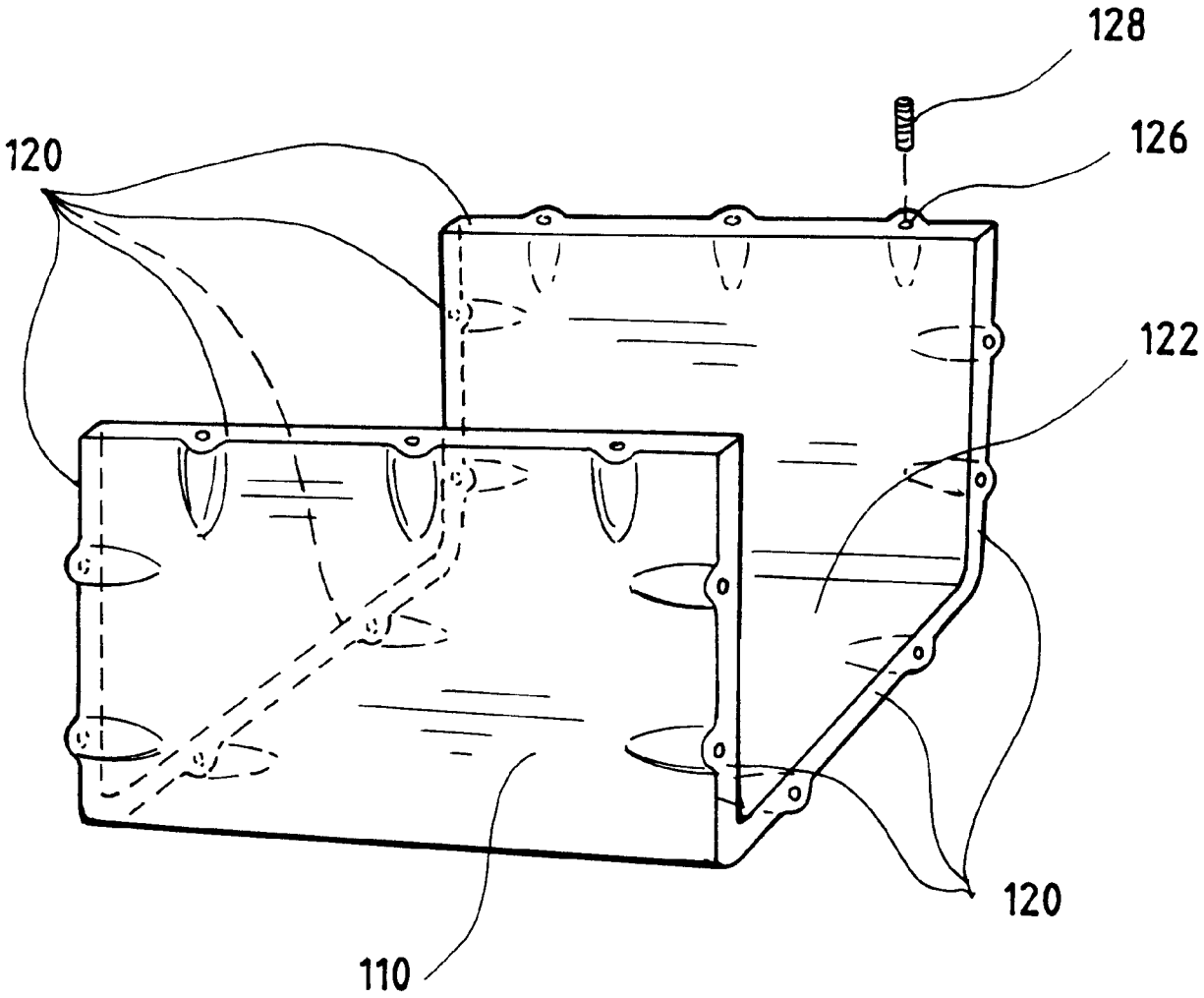
FIG. 10 is a perspective view of a bottom center member of the septic tank.

As shown in FIG. 9, the top center members 106 have two parallel lateral surfaces 110 perpendicular and integral with a top surface 114. The top surfaces 114 of the top center members 106 likewise have semi-circular openings 118 formed at their open sides 120 so that the semi-circular openings 118 align with semi-circular openings 118 of adjacent top members 102, 106 to form complete circular openings when the top center members 106 are connected to adjacent members 102, 106. Bottom center members 108, conversely, comprise two parallel lateral surfaces 110 perpendicular and integral with a bottom surface 122, as shown in FIG. 10. Each top 106 and bottom 108 center member 106, 108 in the illustrated embodiment has eight open sides 120.

Each member 102, 104, 106, 108 further includes a plurality of connection flanges 124 on their respective open sides 120, as depicted in FIGS. 7–10. The connection flanges 124 are located so that they align with one another when adjacent members 102, 104, 106, 108 are connected. The connection flanges 124 can be formed having internally threaded openings 126, for example, to receive bolts 128 and to connect and secure adjacent members 102, 104, 106, 108 to each other. In addition, an adhesive can be used to secure the members to each other to further ensure no seepage occurs.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An adjustable length modular storage container comprising:

a storage section formed from a plurality of container members including at least two end members, the end members being modular and formed from a molded polymer, each end member including two elongated side walls upstanding from and integral with a base, the end members including an integrally formed external end wall at a first end and an integrally formed internal attachment wall at a second end, wherein the container members further include connection members at the attachment walls for attaching the container members to one another; and a cover formed from a plurality of cover members including at least two cover end members, the cover end members being modular and formed from a molded polymer, each cover end member including a top integral with two depending side flaps, the cover members including an integrally formed exterior end slip at a first end and an integrally formed attachment panel formed at a second end, wherein the cover end members further include connection members at the attachment panels for attaching the cover members to one another.

2. The adjustable container as defined in claim 1, wherein the container members have a rib assembly formed therein.

3. The adjustable container as defined in claim 2, wherein the rib assembly includes a lateral rib pattern formed on the side walls, the lateral rib pattern including internally protruding ribs and further including externally protruding ribs; and a supporting rib pattern formed on the base, the supporting rib pattern including alternating open and enclosed portions separated by horizontal dividers, wherein the open portions include at least two vertical dividers forming at least three open sections and the enclosed portions include upper walls extending between the horizontal dividers.

4. The adjustable container as defined in claim 3, wherein the connection members include:

connection flanges formed at upper sections of the attachment walls of the container members and at lower portions of the attachment panels of the cover members, each connection flange defining at least one receiving element therein and positioned so the connection flanges and the receiving elements of adjacent container and cover members align with one another;

a bottom connecting panel formed at the base of the internal attachment walls of the container members, the connecting panels defining at least one receiving element therein and positioned so that the connecting panels and receiving elements of adjacent container members align with one another; and an upper attachment segment formed at the top of the internal attachment panel of the cover members, the upper segment defining at least one receiving element therein and positioned so that the upper segments and receiving elements of adjacent cover members align with one another.

5. The adjustable container as defined in claim 4, wherein the container further includes a plurality of elevated stabilizers attached underneath the base of the members and wherein the tops of the cover members include externally and internally protruding ribs.

6. The adjustable container as defined in claim 1, wherein the storage section is formed from two container end members connected to one another.

7. The adjustable container as defined in claim 1, wherein the connection members include:

connection flanges formed at upper sections of the attachment walls of the container members and at lower portions of the attachment panels of the cover members, each connection flange defining at least one receiving element therein and positioned so the connection flanges and the receiving elements of adjacent container and cover members align with one another;

a bottom connecting panel formed at the base of the internal attachment walls of the container members, the connecting panels defining at least one receiving element therein and positioned so that the connecting panels and receiving elements of adjacent container members align with one another;

an upper attachment segment formed at the top of the internal attachment panel of the cover members, the upper segment defining at least one receiving element therein and positioned so that the upper segments and receiving elements of adjacent cover members align with one another; and a plurality of fasteners for fastening the container and cover members to one another.

8. The adjustable container as defined in claim 1, wherein the container further includes a plurality of elevated stabilizers integral with and underneath the base of the members.

9. An adjustable length modular storage container comprising:

a storage section formed from a plurality of container members including at least two end members, the end members being modular and formed from a molded polymer, each end member including two elongated side walls upstanding from and integral with a base, the end members including an integrally formed external end wall at a first end and an integrally formed internal attachment wall at a second end, wherein the end members further include connection members at the attachment walls;

the storage section further including at least one center container member, the center member being modular and formed from a molded polymer, each center member including two elongated side walls upstanding from and integral with a base, the center members including integrally formed internal attachment walls at first and second ends of the center members and connection members at the attachment walls, wherein the connection members of the container members facilitate attaching the container members to one another; and a cover formed from a plurality of cover members including at least two cover end members and at least one cover center member, the cover members being modular and formed from a molded polymer, each cover end member including a top integral with two depending side flaps, the cover end members having an integrally formed exterior end slip at a first end and an integrally formed internal attachment panel at a second end, each cover center member including a top integral with two depending side flaps, the cover center members having integrally formed attachment panels formed at first and second ends of the cover center members, wherein the cover end and center members further include connection members at the attachment panels for connecting adjacent cover members to one another.

10. The adjustable container as defined in claim 9, wherein the members have a rib assembly formed therein.

11. The adjustable container as defined in claim 10, wherein the rib assembly includes:

a lateral rib pattern formed on the side walls, the lateral rib pattern including internally protruding ribs and further including externally protruding ribs; and a supporting rib pattern formed on the base, the supporting rib pattern including alternating open and enclosed portions separated by horizontal dividers, wherein the open portions include at least two vertical dividers forming at least three open sections and the enclosed portions include upper walls extending between the horizontal dividers.

12. The adjustable container as defined in claim 11, wherein the connection members include:

connection flanges formed at upper sections of the attachment walls of the container members and at lower portions of the attachment panels of the cover members, each connection flange defining at least one receiving element therein and positioned so the connection flanges and the receiving elements of adjacent container and cover members align with one another;

a bottom connecting panel formed at the base of the internal attachment walls of the container members, the connecting panels defining at least one receiving element therein and positioned so that the connecting panels and receiving elements of adjacent container members align with one another;

an upper attachment segment formed at the top of the internal attachment panel of the cover members, the upper segment defining at least one receiving element therein and positioned so that the upper segments and receiving elements of adjacent cover members align with one another.

13. The adjustable container as defined in claim 12, wherein the container further includes a plurality of elevated stabilizers integral with and underneath the base of the members and wherein the tops of the cover members include externally and internally protruding ribs.

14. The adjustable container as defined in claim 9, wherein the storage section is formed from two container end members and one container center member connected to one another.

15. The adjustable container as defined in claim 9, wherein the connection members comprise:

connection flanges formed at upper sections of the attachment walls of the container members and at lower portions of the attachment panels of the cover members, each connection flange defining at least one receiving element therein and positioned so the connection flanges and the receiving elements of adjacent container and cover members align with one another;

a bottom connecting panel formed at the base of the internal attachment walls of the container members, the connecting panels defining at least one receiving element therein and positioned so that the connecting panels and receiving elements of adjacent container members align with one another; and an upper attachment segment formed at the top of the internal attachment panel of the cover members, the upper segment defining at least one receiving element therein and positioned so that the upper segments and receiving elements of adjacent cover members align with one another.

16. The adjustable container as defined in claim 9, wherein the container further includes a plurality of elevated stabilizers integral with and underneath the base of the members.

17. A molded, polymeric septic tank comprising:

two top end members, each top end member including two parallel lateral surfaces perpendicular and integral with an end surface and a top surface, the end surface defining a circular opening therein and the top surface defining a semi-circular opening formed at an open side of the top surface so that the semi-circular openings on the top surfaces of adjacent top members align with one another to form a circular opening when adjacent top end members are attached to one another, wherein each top end member further includes six open sides, each open side including integrally formed connection members; and two bottom end members, each bottom end member including two parallel lateral surfaces perpendicular and integral with an end surface and a bottom surface, wherein each bottom end member further includes six open sides, each open side including integrally formed connection members so that each top and bottom member is attached to an adjacent member at its open sides by the connection members.

18. The septic tank as defined by claim 17, wherein the septic tank further includes at least one top center member, each top center member including two parallel lateral surfaces perpendicular and integral with a top surface, the top surface defining a semi-circular opening at each open side so that the semi-circular openings on the top surfaces of adjacent top members align with one another to form a circular opening when adjacent top members are attached to one another, wherein the top center member further includes eight open sides, each open side including integrally formed connection members; and at least one bottom center member, each bottom center member including two parallel lateral surfaces perpendicular and integral with a bottom surface, wherein the bottom center member further includes eight open sides, each open side including integrally formed connection members so that each member is attached to an adjacent member at its open sides by the connection members.

19. The septic tank as defined by claim 18, wherein the connection members include connection flanges, each connection flange forming at least one threaded hole therein and positioned so that connection flanges of adjacent members align with one another.

* * * * *